United States Patent [19]

Kibby

[11] 4,216,010

[45] Aug. 5, 1980

[54] ALUMINUM PURIFICATION SYSTEM

[75] Inventor: Robert M. Kibby, Richmond, Va.

[73] Assignee: Reynolds Metals Company, Richmond, Va.

[21] Appl. No.: 7,986

[22] Filed: Jan. 31, 1979

Related U.S. Application Data

[63] Continuation-in-part of Ser. No. 881,786, Feb. 27, 1978, abandoned, which is a continuation-in-part of Ser. No. 785,676, Apr. 7, 1977, abandoned.

[51] Int. Cl.[2] ..... C22D 3/12

[52] U.S. Cl. ..... 75/68 A; 75/10 R

[58] Field of Search ..... 75/68 A, 10 R

[56] References Cited

U.S. PATENT DOCUMENTS 3,068,092 12/1962 Menegoz ..... 75/68 A 3,971,653 7/1976 Cochran ..... 75/68 A

FOREIGN PATENT DOCUMENTS 265563 8/1927 United Kingdom ..... 75/68 R

*Primary Examiner*—M. J. Andrews

*Attorney, Agent, or Firm*—Glenn, Lyne, Girard, Clark & McDonald

[57] ABSTRACT

A method for extracting aluminum of substantial purity from furnace products resulting from carbothermic reduction of alumina-bearing ores and contaminated with up to about 30 weight percent of aluminum carbide is disclosed. The method involves contacting the furnace product with a high alumina-containing molten slag in the substantial absence of reactive carbon, so as to cause the alumina-containing slag to react with the aluminum carbide, thereby diminishing the aluminum carbide content of the furnace product.

8 Claims, 5 Drawing Figures

COMMERCIALLY PURE ALUMINUM

ALUMINUM PURIFICATION SYSTEM

CROSS-REFERENCE TO RELATED APPLICATIONS

This application is a continuation-in-part of U.S. patent application Ser. No. 881,786, filed Feb. 27, 1978 which in turn is a continuation-in-part of application Ser. No. 785,676, filed Apr. 7, 1977, both now abandoned.

BACKGROUND OF THE INVENTION

This invention relates to the recovery of substantial quantities of aluminum containing no more than about 2 weight percent of aluminum carbide from furnace products resulting from the carbothermic production of aluminum.

Carbothermic processes involving the reduction of alumina-bearing ores with carbonaceous reductants have long been disclosed in the literature. Unfortunately, however, it has not been possible to obtain significant amounts of substantially pure aluminum from the vast majority of heretofore practiced operations unless special procedures were utilized.

DESCRIPTION OF THE PRIOR ART

Reference to the literature and patent art will indicate that there has been much activity by many people in an attempt to adequately define a thermal process which can compete advantageously with the conventional electrolytic methods of preparing aluminum. The art has long been aware of the many theoretical advantages which can flow from the use of a thermal operation for the production of aluminum as opposed to an electrolytic method. Unfortunately, the vast majority of carbothermic processes did not result in a significant production of aluminum in a substantially pure state.

The difficulty in producing aluminum with respect to thermal processes does not reside in the formation of the aluminum via reduction of the alumina-bearing ores, but rather, in the recovery of aluminum in a substantially pure state. The patent art, as well as the literature is full of theories and explanations with respect to various back reactions which can take place between aluminum and the various carbon-containing compounds in the feed, i.e. see U.S. Pat. No. 3,971,653.

One solution to the general problem of obtaining substantially pure aluminum from a carbothermic process is disclosed and claimed in U.S. Pat. No. 3,607,221. Although the process of this patent does result in the production of aluminum in a substantially pure state, nevertheless, extremely high operating temperatures are involved which can lead to problems with respect to materials of construction. Another method for recovering substantially pure aluminum via a carbothermic process is disclosed and claimed in U.S. Pat. No. 3,929,456. The process of this patent also results in the production of substantially pure aluminum via a carbothermic process, but it does require careful control of the way the charge is heated in order to avoid aluminum carbide contamination.

By far, the most common technique disclosed in the prior art in attempting to produce aluminum of a high degree of purity was directed at various methods of treating the furnace product which conventionally contained 10-20 weight percent of aluminum carbide. Thus, there are conventional techniques disclosed in the prior art, such as fluxing a furnace product with metal salts so as to diminish the amount of aluminum carbide contamination.

Unfortunately, the molten salt mixed with the carbide so removed and it is costly to remove the carbide from the salt so that the carbide can be recycled to the furnace. Without such recycle, the power consumption and furnace size becomes uneconomical in comparison with prior methods practiced commercially for making aluminum. U.S. Pat. No. 3,975,187 is directed towards a process for the treatment of carbothermically produced aluminum in order to reduce the aluminum carbide content thereof by treatment of the furnace product with a gas so as to prevent the formation of an aluminum-aluminum carbide matrix, whereby the aluminum carbide becomes readily separable from the alumina. Although the process of U.S. Pat. No. 3,975,187 is very effective in preserving the energy already invested in making the aluminum carbide, nevertheless, said process required a recycle operation with attendant energy losses associated with material handling. In one embodiment, the instant process converts the aluminum carbide to metallic aluminum, thereby completing the reduction process and minimizing energy losses. Furthermore, as pointed out at column 4, lines 31 and following, a particularly preferred embodiment of U.S. Pat. No. 3,975,187 resides in treatment of aluminum which is contaminated with no more than about 5 weight percent of aluminum carbide.

The process of the instant invention is effective with any amount of aluminum carbide contamination greater than about 2 weight percent. However, as indicated earlier, unless special procedures are used, e.g. U.S. Pat. Nos. 3,607,221; and 3,929,456; the amount of aluminum carbide contaminant which is produced by a so-called conventional reduction furnace ranges from about 10 to about 20 weight percent.

The instant invention is directed particularly towards treatment of aluminum which is contaminated with from about 10 to about 20 weight percent of aluminum carbide which is that amount of carbide contamination which is produced by a so-called conventional carbothermic reduction furnace, but it may also be used to treat aluminum which is contaminated with about 2 to about 10 weight percent aluminum carbide as would be produced in furnaces used primarily for the production of aluminum such as those described in U.S. Pat. Nos. 3,607,221 and 3,929,456.

DESCRIPTION OF THE PREFERRED EMBODIMENTS

The novel process of this invention is carried out simply by heating the furnace product contaminated with aluminum carbide with a molten slag containing substantial proportions of alumina so as to cause the alumina in the slag to react with the aluminum carbide in the furnace product, thereby diminishing the furnace product of aluminum carbide. The expression "alumina in the slag to react with the aluminum carbide" is intended to describe various modes of reaction. While not wishing to be limited to a particular theory of operation, nevertheless, it appears that at least 2 modes of reaction as between the alumina in the slag and the aluminum carbide in the furnace product are possible.

One such mode can be described as the "reduction mode" and it involves reaction between the alumina in the slag and the aluminum carbide in the furnace product at reduction conditions so as to produce aluminum metal. One way of ascertaining operation in this mode is by the evolution of carbon monoxide.

Another such mode of reaction can be described as the "extraction mode" and it involves reaction between the alumina in the slag and the aluminum carbide in the furnace product so as to produce non-metallic slag compounds such as aluminum tetraoxycarbide, as opposed to producing liquid aluminum. Such "extraction mode" reactions occur at temperatures insufficient to cause reduction to produce additional aluminum and can occur without causing the evolution of carbon monoxide.

It is to be understood that said "extraction mode" can take place along with the "reduction mode."

In general, temperatures of at least 2050° C. are necessary for the "reduction mode" operations at reaction zone pressures of one atmosphere. At any given pressure, the temperature required for "reduction mode" operation increases as the level of aluminum carbide in the metal decreases. On the other hand, "extraction mode" operations can take place below 2050° C.

The reaction of the furnace product with the molten slag can be carried out partially or completely in the same reduction furnace which was used to prepare the metallic aluminum or the furnace product from a carbothermic reduction process can be tapped into a separate furnace containing an appropriate molten slag and the decarbonization can take place in a separate furnace. It is to be understood that this invention includes partially decarbonizing the furnace product in the furnace in which it was made followed by completing the decarbonization in a separate furnace. It is absolutely crucial in the novel process of this invention that the decarbonization reaction take place in the absence of reactive carbon. It should appear quite obvious that if reactive carbon were present during the decarbonization operation, it would have a tendency to react with the metal being decarbonized and produce more aluminum carbide thereby frustrating the novel process of this invention.

Thus, for example, in those situations where the same furnace is used both to carry out the reduction of alumina-bearing ores in order to produce aluminum followed by decarbonization of the aluminum via the molten slag technique of this invention, it is absolutely crucial that the decarbonization step be carried out in the absence of reactive product in contact with the metal being decarbonized. In a situation just mentioned this would necessitate raising the carbon electrodes from deep immersion in the melt to a point where they barely contact the surface of the melt or are completely removed therefrom, as well as the use of a furnace which isolates any carbon lining from contact with the melt to be decarbonized, as with a non-reactive skull between a carbon lining and the furnace melt. The expression "substantial absence of reactive carbon" as used in the specification and claims is intended to mean that any reactive carbon which may be present during decarbonization is insufficient to overcome the decarbonizing reaction of aluminum carbide with alumina. Obviously, the most preferred embodiment has substantially no reactive carbon present to react with the aluminum formed in the decarbonization step. The expression "reaction carbon" means any carbon that is present during the decarbonization step (such as carbon electrodes immersed in the melt) unless special precautions have been taken to make it unavailable to react with aluminum, e.g. coating the carbon lining of a furnace shell with a non-reactive skull. The molten slags which are used in carrying out the novel process of this invention are not narrowly critical but they must possess certain characteristics in order to be useful. As has heretofore been pointed out, the molten slags are rich in alumina and in principle it might appear that pure alumina could be used but such is not preferred. In a large scale furnance, one would have to contain the molten alumina in something and in view of the fact that the melting point of more alumina is about 2320° K., it is too close to the reaction reduction temperature which is usually around 2400° K. Thus, it is definitely preferred that the molten slag which is rich in alumina have the lowest feasible melting point. In this connection, mixtures of aluminum carbide and alumina in the range of 80–97 weight percent alumina can be employed. The preferred range of alumina in mixtures with aluminum carbide is from 85–90 weight percent.

One particularly preferred embodiment of the novel process of this invention resides in the use of slag containing calcium oxide since slags of this type have a lower melting point. It is to be understood that the majority of the slag does not have to be at the reduction temperature. It only has to be molten and at a high enough temperature to exist as a molten layer separate from the metal layer. However, the slag closest to the arc is at reduction temperature when operating in the reduction mode. It has been found, therefore, than an easier decarbonization is obtained if the slag contains sufficient calcium oxide to reduce its fusion temperature to about 1500° C. A typical slag for 1500° C. operation would contain from 0 to about 18 weight percent aluminum carbide, 40–45 weight percent calcium oxide, 0–5 percent magnesium oxide, the balance being alumina. It is to be understood, however, that lesser amounts of calcium oxide can be present in the slag, i.e. as low as 10 weight percent up to the maximum of about 55 weight percent—the balance being alumina with or without minor impurities which will in no way affect the operation of the decarbonization process. However, slags containing less than 40–45 weight percent calcium oxide will require a higher temperature to be molten.

The slags used in the process of this invention referred to as "rich in alumina" or "high alumina containing" are those wherein the weight ratio of alumina to any aluminum carbide contained therein is at least 4:1. It is also noted that the weight percentages of alumina and aluminum carbide is but a convenient and art-recognized way of expressing the aluminum, oxygen and carbon content of the slags.

After the decarbonization reaction has been completed, the aluminum metal depleted in aluminum carbide can be further purified by conventional techniques, such as those disclosed in U.S. Pat. No. 3,975,187.

Figure 1:
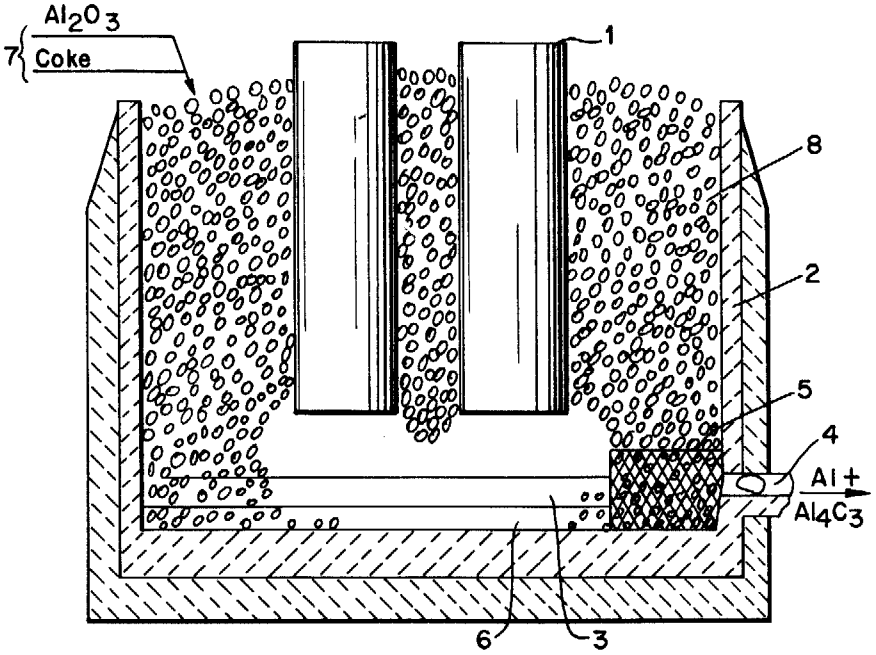
FIG. 1 represents an electric arc furnace suitable for carrying out the novel process of this invention. The carbon electrodes 1 are in sets of three so as to use three-phase alternating current. The furnace is lined with a refractory wall 2 of carbon and insulated by brick, and said furnace can be provided a channel 5 to ensure the flow of liquid layer 3 to the tapping port 4. A molten slag 6 is provided at the base of the furnace and charge column 8 allows the reactants 7 to be charged into the furnace.

The following examples will now illustrate the best mode contemplated for carrying out the novel process of this invention.

EXAMPLE 1

A slag was prepared having a composition 14.28 weight percent aluminum carbide, 85.72 weight percent alumina and said slag was fused in an induction furnace prior to use. 50 g of a furnace product resulting from the carbothermic reduction of alumina-bearing ore having a composition of about 11 weight percent $Al_4C_3$ and 81% aluminum were placed on top of the slag in an insulated crucible having a graphite coverplate containing a three-inch hole. An arc was initially struck to the inner rim of the hole in the graphite coverplate so as to cause the tail flame from this arc to heat the slag and metal charge until electrical conductivity through the charge was established, after which the arc was maintained between the electrode and the slag. The metal charge fused and most of it collected as a lens floating on top of the molten slag.

After the system cooled, a decarbonized metal button was removed and analyzed. Of the 40.5 grams of aluminum in the feed, 27.1 grams having a carbide content of 1.2 wt. % were recovered.

EXAMPLE 2

The process of Example 1 was repeated with the exception that only 36 grams of carbothermic furnace product was used and the molten slag employed had the composition of 25 weight percent calcium oxide and 75 weight percent alumina. This slag had been fused in an induction furnace prior to use.

The action of heat for this slag was similar to that for Example 1 except for an apparent lower electrical conductivity of the slag until the metal is present and a difference in the adherence of the frozen slag to the solid metal product. Of the 29.16 grams of aluminum in the feed, 19.0 grams of aluminum having a carbide content of 1.2 weight percent were recovered.

An additional benefit residing from the use of the calcium slag of this example is that the structure of the decarbonized metal produced over this slag appears to be better since it flowed more easily at 1000° C.

EXAMPLE 3

The process of Example 2 was repeated except that 31.5 grams of a furnace product which had been exposed to air and which had a composition 47.1 weight percent aluminum, 7.6 weight percent aluminum carbide, balance alumina were used. After being decarbonized, the resulting product was substantially free of aluminum carbide contamination and, in fact, although the feed contained 14.83 grams of aluminum, 17.0 grams of products were recovered. This indicates clearly that at least part of the carbide contained in the feed was converted to aluminum by reaction with alumina.

EXAMPLE 4

A slag was prepared having a composition of 33.3 wt. % Cao, 3.5% MgO and 63.2% $Al_2O_3$. The slag was prefused before the test.

Forty-seven grams of carbothermic furnace product having a composition of 33.4% $Al_4C_3$ and 65.8% aluminum were placed on top of the slag and heated as in Examples 1 and 2.

The action under heat for this slag was similar to that for Examples 1 and 2, except that the metallic material was difficult to fuse and the movement of the slag and metallic material was sluggish compared to the 25% CaO 75% $Al_2O_3$ slag. The metallics formed a separate phase on the surface of the slag.

The feed contained 31.1 grams of aluminum and 30.03 grams of metal containing 1.54% $Al_4C_3$ were recovered.

EXAMPLE 5

A slag was prepared having a composition of 35 wt. % CaO and 65% $Al_2O_3$. The slag was prefused before the test.

Forty-seven grams of a carbothmeric furnace product having a composition of 37% $Al_4C_3$ and 61.1% aluminum were placed on top of the slag and heated as in Examples 1 and 2.

This run was similar to the previous runs except it was easier to fuse the slag and metallics and the heating time was extremely short compared to the previous run. The metallic materials consolidated well into a single lense floating on top of the slag. Only a small amount of metallics was found mixed with the slag.

The feed contained 28.42 grams of aluminum, but 30.77 grams of aluminum containing 1.98 weight percent $Al_4C_3$ were recovered, indicating reaction between the slag and the aluminum carbide to produce liquid aluminum.

EXAMPLE 6

This example will illustrate the novel process of this invention using the furnace of FIG. 1.

A charge 7 is made up in the form of briquettes having two compositions. In the preparation of the briquettes (see U.S. Pat. No. 3,723,093; column 8, lines 50–65) aluminum hydroxide powder in accordance with the Bayer method is converted to alumina powder by heating at 600°-1000° C. This alumina powder and petroleum coke powder ground to pass 100 mesh screen are mixed in weight ratio 85:15 for charge composition A and in weight ratio 65:35 for charge composition B. One hundred parts by weight of the well blended aggregates of each charge composition are mixed with 30 parts by weight of an organic binder: an aqueous 6% solution of polyvinyl alcohol. The mixtures are then compression molded into almond-shaped briquettes having a long diameter of 4 cm using a double roll briquette machine, following which the briquettes are dried for four hours in 100°-150° C. air stream.

The starting operation of bring the furnace up to its steady condition is carried out in the following manner:

The furnace is initially heated by flow of current from the electrodes to a bed of crushed coke as in the practice for starting a silicon furnace. When the hearth is adequately heated according to silicon furnace practice, sufficient alumina is added to form a liquid layer 6 over the hearth. The composition of layer 6 is equivalent to a melt of alumina and aluminum carbide having alumina in the weight range 80%to 97%. The preferred range is 85% to 90% $Al_2O_3$, balance $Al_4C_3$. Then, charge of composition A is added and the electrode pulled up to open arc to build up liquid layer 6 to a depth of approximately 12". As charge A is added and smelted to produce liquid for layer 6, additional alumina is added to maintain the weight ratio in liquid layer 6 in parts by weight range 80 $Al_2O_3$/20 $Al_4C_3$ to 97 $Al_2O_3$/3 $Al_4C_3$. Only enough briquettes of composition A are added to provide the desired depth of layer 6. This is the "slag"layer. If the slag layer should become too lean in its content of $Al_4C_3$, a correction can be made by adding coke and continuing the heating under the open arc.

When the molten slag layer of desired composition has been established the reduction charge is added to surround the electrodes to the full designed depth of charge, thus providing a charge column 8 in which vapor products can react and release heat. Normally the reduction charge is a blend of charge compositions A and B in weight proportions 42.7/75.3. Over the long range this charge is balanced to produce aluminum containing 2% $Al_4C_3$ as hereinafter discussed. The ultimate effect of minor unbalances in the charge composition, i.e. ±5% in the proportion of $Al_2O_3$ is a change in the slag composition. So, the slag is periodically sampled and analyzed and furnace charge ratio of A to B is adjusted to bring the slag into the preferred control range set forth above.

If the slag analysis indicates a trend toward depletion of alumina, the ratio of A to B is increased. If the slag analysis indicates a trend toward depletion of $Al_4C_3$ the ratio of A to B is decreased.

As reduction proceeds, aluminum containing from 10 to 20% $Al_4C_3$ is formed and rests as a separate liquid layer over the slag layer. At the same time some aluminum vapor and aluminum monoxide ($Al_2O$) gas is produced. These mix with the CO formed by the aluminum producing reaction and pass upwardly through the charge column 8, where back reactions occur, releasing heat and producing compounds which recycle down with the charge to produce aluminum. The heat released in column 8 is used to pre-heat charge and to provide heat to cause charge A to produce $Al_4O_4C$. At a higher temperature closer to the arc, charge composition B reacts to produce $Al_4C_3$. Finally the $Al_4C_3$ and $Al_4O_4C$ produced in the charge column 8 receive heat from the arc and produce aluminum containing from 10-20% $Al_4C_3$ and the vapor products previously discussed.

The heat intensity reaching the charge from the arc must be limited, otherwise the vaporization will be so great that pre-heat and pre-reduction reactions in charge column 8 cannot absorb the back reaction heat. Under these conditions the furnace is thermally unstable, and unreacted vapor products will blow out the top of the charge, releasing excessive heat and wasting valuable reactants. The tailoring of furnace and electrode dimensions in relation to heat release by the arc to avoid such thermal instabilities is known by those skilled in the art of electric furnace design.

The proper level (intensity) of arc heat for thermally stable reduction and its related current and voltage values for a particular furnace capacity will be called level X.

To convert the reduction product containing from 10 to 20% carbide to a product containing about 2% carbide, a second mode of operation is periodically employed where the heat level Y is substantially less than level X, i.e. from 10 to 50% of level X, but in any event low enough that no further reduction of the charge from column 8 occurs. Heat level Y is applied by open arc to the surface of the melt resting on the hearth of the furnace. Under these conditions, the aluminum carbide contained in the metal layer reacts with the alumina contained in the slag layer and such alumina as may be contained in the metal layer to produce more liquid aluminum and CO and a minor amount of aluminum vapor and $Al_2O$ gas. The carbide level in the metal layer is reduced thereby to about 2%, and the vapors pass up through the charge column to back react and release heat as under reduction conditions.

The degree of decarbonization in this mode of furnace operation can be judged by the fluidity of the metal layer or by a simple known chemical analysis.

Before the furnace is returned to heat level X necessary for further reduction of charge, the furnace is tilted to pour out decarbonized aluminum containing about 2% carbide, and any surplus slag that may have been produced because of corrections to slag composition previously mentioned. The two layers of melt are mutually immiscible at these conditions, so the aluminum pours off first, followed by the slag. The aluminum is transferred to a holding furnace where it is fluxed with tri-gas by known practice to produce commercially pure aluminum, i.e. the processes of U.S. Pat. No. 3,975,187.

Excess slag and skim from the fluxing furnace are cooled to ambient temperature and returned to the charge preparation operation.

The decarbonization condition established under heat flux Y is that the portion of the metal layers closest to the limited arc is brought to a temperature (~2100° C.) sufficient to react $Al_2O_3$ with $Al_4C_3$ to produce aluminum, but the majority of the slag is at a lower temperature (about 1900° C.), the unreacted charge is not up to reduction temperature and is dormant with respect to rapid solution of its carbon content into the product aluminum, and the carbon electrode is not in contact with the product aluminum.

EXAMPLE 7

The furnace and charge preparation are the same as in Example 6. The practice of this Example differs from that in Example 6 primarily in that, under reduction mode, the heat flux X is achieved by resistance heating with the electrode submerged in the metal layer. This has the advantage that heat flux to the reductants can be less than the heat flux under an open arc from carbon electrodes and vaporization can be less. The aluminum will absorb more carbide, however, and a greater period of time will be required for decarbonization.

After a liquid layer of aluminum containing about 20% $Al_4C_3$ has been produced by operation in the reduction mode, the electrodes are pulled up to an open arc and heat flux Y is established as in Example 6 to decarbonize the melt. When the metal is decarbonized as described in Example 6, the metal is tapped to a holding furnace and the electrodes are immersed again for another reduction period.

EXAMPLE 8

Figure 2:
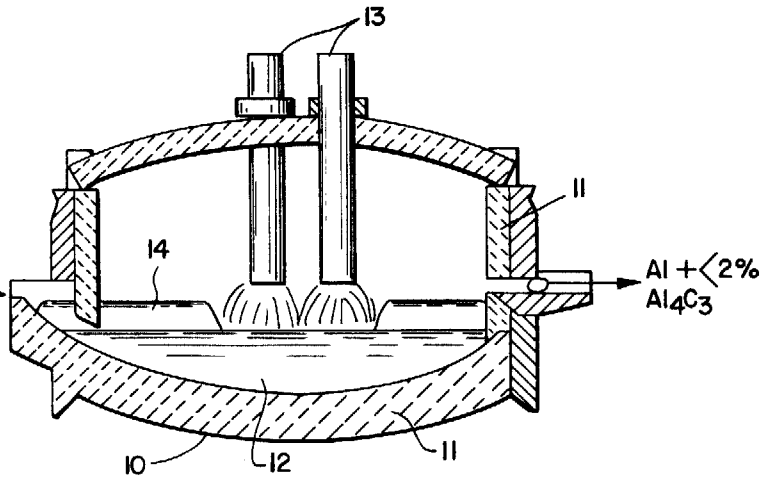
FIG. 2 represents that embodiment wherein the decarbonization reaction takes place outside the main reduction furnace and, in this connection, furnace 10 is an electric furnace typically used in the melting or iron or steel having a lining 11 of alumina brick containing no carbon. Slag 12 rests on the bottom of the electric furnace and an aluminum layer 14 rests of top of the slag. Arcs from electrodes 13 impinge upon the melt layers 12 and 14 causing the metal 14 to react with slag layer 12.
Figure 2:
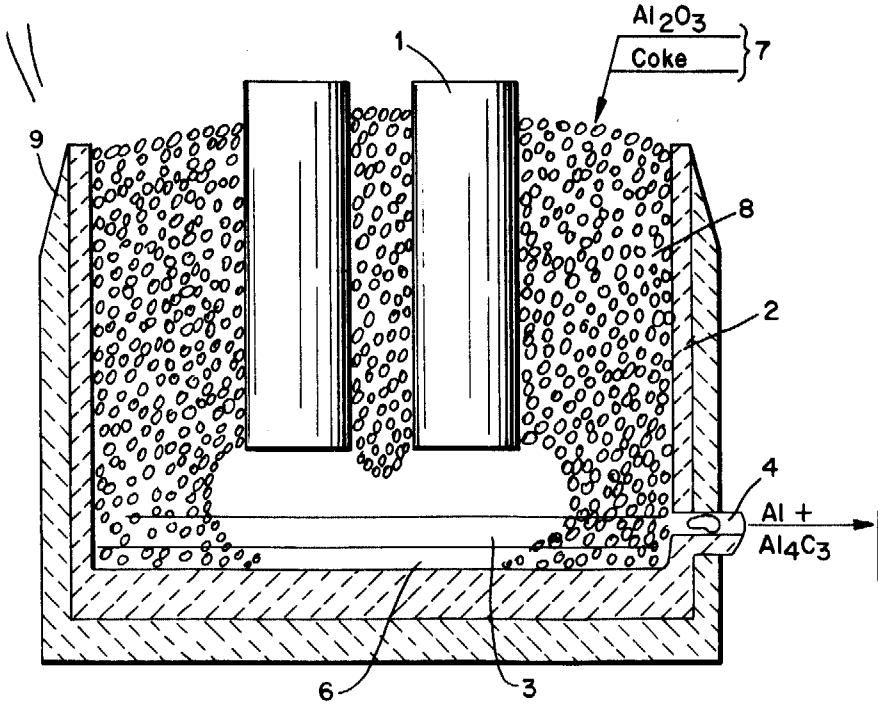

The furnace construction, startup procedure and charge preparation are the same as in Example 6. The difference is that furnace 9 operates continuously in reduction mode as described in Example 1, and the metal layer containing from 10–20% carbide is tapped periodically to a second furnace 10 where decarbonization occurs. This system is illustrated in FIG. 2.

Furnace 10 is an electric furnace, typically used for the melting or iron or steel. The lining 11 is of high alumina brick and contains no carbon. Slag 12 is controlled by addition of alumina to maintain a composition equivalent to a weight ratio of alumina to aluminum carbide in the range of 80–97% alumina, balance $Al_4C_3$, and preferably in the range of 85% to 90% $Al_2O_3$, balance $Al_4C_3$. Aluminum containing from 10 to 20% $Al_4C_3$ is periodically transferred from furnace 9 to furnace 10. Any surplus slag in furnace 9 is also transferred to furnace 10. Heat from open arcs from electrodes 13 cause the $Al_4C_3$ in the metal layer 14 to react with $Al_2O_3$ in the slag layer and such alumina as may be in the metal layer to produce aluminum, CO, and a minor amount of Al vapor and $Al_2O$ gas. These gases are oxidized by contact with air in the furnace to produce $Al_2O_3$ and $CO_2$, and cooled to separate the particulates which are returned to the reduction charge preparation area. After the carbide level in the metal layer has been reduced to about 2%, the metal layer is tapped to a holding furnace where fluxing with tri-gas according to known practice, i.e. U.S. Pat. No. 3,975,187, converts the metal layer to commercially pure aluminum.

Following each metal tap from furnace 10 alumina is added to slag 12 to restore the $Al_2O_3/Al_4C_3$ ratio to the preferred control range cited above.

The advantage of the method and apparatus of this example over the single furnace apparatus of Examples 6 and 7 is that more positive steps are taken through apparatus arrangement to provide conditions for decarbonization. The apparatus of this example positively excludes the possibility of contact of reactive carbon with the melt being decarbonized.

The majority of the slag does not have to be at the reduction temperature. It only has to be molten and at high enough temperature to exist as a molten layer separate from the metal layer. However, the slag closest to the arc is at reduction temperature. It has been found, therefore, that an easier decarbonization is obtained if the slag contains sufficient lime (CaO) to reduce its fusion temperature to about 1500° C. A typical slag for 1500° C. operation would contain 0–20% $Al_4C_3$, 40–55% CaO, 0–5% MgO, balance $Al_2O_3$. This allows all heated furnace parts to be at temperatures of approximately 1500° C. instead of 1900° C. as would be the case without melting point depressants such as CaO or a combination of CaO and MgO. An additional benefit in using a calcium slag resides in the fact that the decarbonization can be carried out in two stages. It has been observed that when the furnace products contact said calcium slag, a portion of the aluminum produced in a relatively pure state floats to the top of the slag wherein it can be recovered if desired by conventional means such as decantation. The remainder of the furnace product is then reacted with the slag at reduction temperatures in the manner previously described in order to recover more aluminum. This preferred embodiment has the obvious benefit of treating only a portion of the furnace product at reduction temperatures, thereby requiring less energy and incurring less vaporization losses.

Of course, the furnace operation of Example 7 can be made continuous with periodic transfer of metal containing about 20% aluminum carbide to the furnace 10 of Example 8, the where decarbonization and subsequent conversion to produce commercially pure aluminum are carried out as described in Example 8.

EXAMPLE 9

Figure 3:
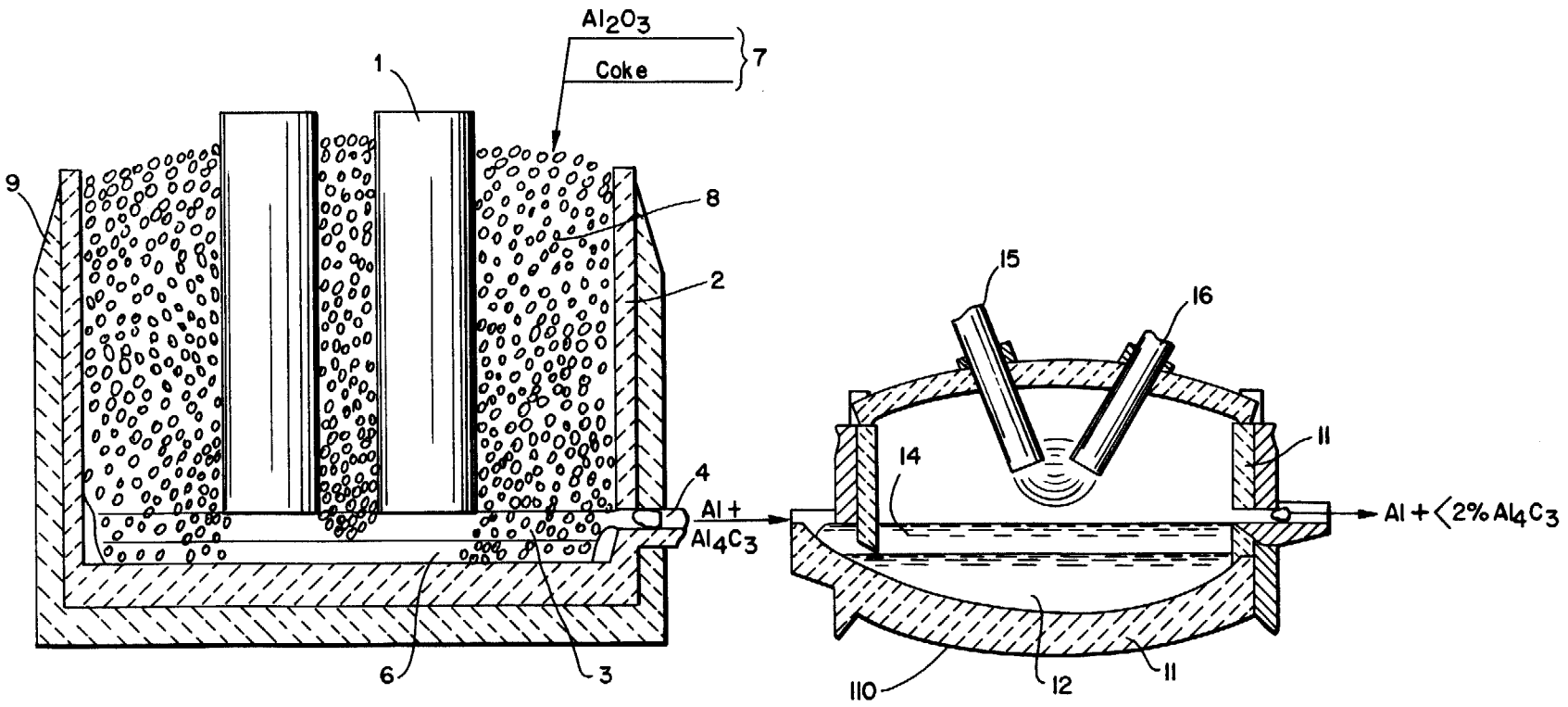
FIG. 3 represents a continuous operation wherein melt containing about 20 weight percent carbide is periodically transferred to a decarbonization furnace 110. However, the decarbonizing heat is supplied by radiation from arcs between electrodes 15 and 16 and not by arc impingement on the slag-metal melt. Layer 14 is aluminum containing decreasing amounts of $Al_4C_3$ depending on the degree of decarbonization.

This example utilizes the embodiment represented in FIG. 3.

The submerged arc reduction is as in Example 7, except that the reduction operation is continuous. Metal containing about 20% carbide is periodically transferred to a decarbonization furnace the same as described in Example 8, except that the decarbonizing heat is received by radiation from arcs between electrodes 15 and 16 an not by an impingement on the slag-metal melt.

This combination provides the best apparatus of those thus far described to avoid excessive vaporization while positively excluding the possibility of contact of reactive carbon with the melt being decarbonized.

EXAMPLE 10

Figure 4:
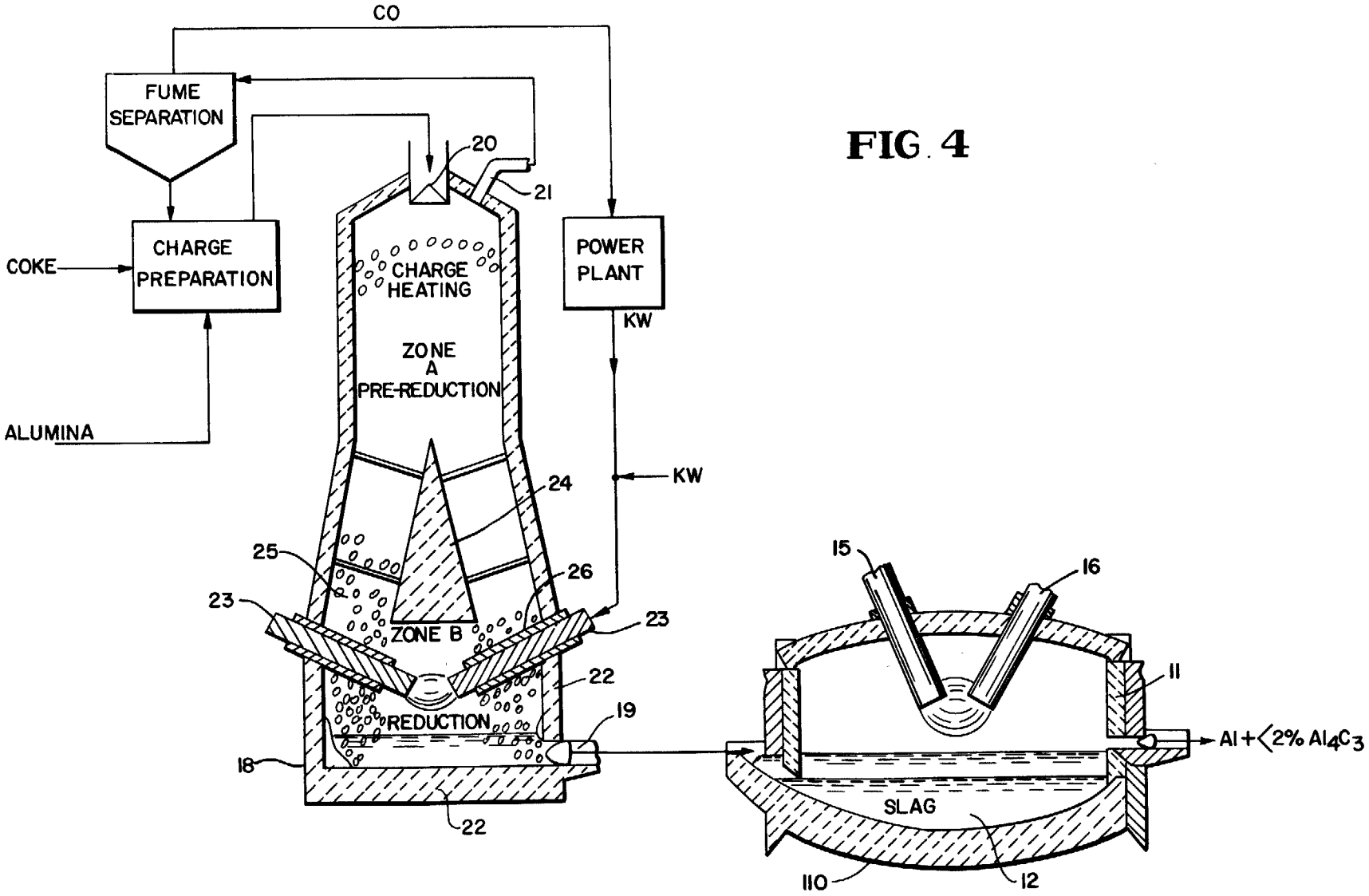
FIG. 4 represents still another furnace which is operable in the novel process of this invention. Furnace 18 is a moving bed shaft furnace which is closed, except for tapping port 19, charge admission lock 20, the gas vent 21. The furnace is lined with carbon 22 and electric arcs flow between two or more of electrodes 23. Means 24 constructed of carbon are provided to shape the charge 25 descending and insulating means 26 is provided so that electrical conduction through the charge is minimized.

FIG. 4 illustrates a system directed on large (50 MW) reduction furnaces having means to recover fuel values from the reduction product CO, while minimizing vaporization products from the reduction zone, and positive means to avoid contact between reactive carbon and the melt being decarbonized.

Referring to FIG. 4, the furnace 18 is a moving bed shaft furnace which is closed except for tapping port 19, charge admission lock 20 and gas vent 21. The furnace is lined with carbon 22 and provided with adjustable electrode means, not shown, to cause electric arcs to flow between two or more electrodes 23. Means 24 constructed of carbon are provided to shape the charge 25 descending and insulating means 26 is provided so that electrical conduction through the charge is minimized.

In one embodiment, a two part charge A and B is prepared as described in Example 6. As the charge descends through zone A, heat released by the back-reaction of vapor products from Zone B is absorbed to produce pre-reduction products, principally $Al_4O_4C$.

As the charge descends closer to the source of arc heat, reactions occurs to produce aluminum carbide.

Finally, the charge, now having a composition substantially of the proportion of one mole of $Al_4O_4C$ to one mole $Al_4C_3$, receives heat by radiation from the arc to produce liquid aluminum containing about 10% $Al_4C_3$, and some slag comprising alumina and $Al_4O_4C$. The reduction reaction is endothermic and adjusts its temperature to that required for reduction. The distance between the arc and the charge receiving heat from the arc is also self adjusting; if the charge is too close to the arc, the heat flux to the charge is too high, excessive vaporization occurs and the charge surface recedes until the heat flux is appropriate for the reaction rates obtainable. When, by this natural process, thermal stability is achieved, liquid aluminum is continuously produced on the surface of the charge pellets and vaporization at Zone B is characteristic of equilibrium for the reactants $Al_4O_4C$ and $Al_4C_3$. Thus, at one atmosphere pressure, the vaporization from Zone B is in the form of aluminum vapor and $Al_2O$ (gas) containing about 18% of the aluminum values in the charge. At two atmospheres pressure, the aluminum content of the vapors is about 15% of the aluminum values in the charge. These vapors back react with CO from the reduction Zone B to produce compounds that can be recycled to Zone B to produce aluminum. The back reaction heat is released at a temperature higher than the reaction temperature to produce $Al_4O_4C$ and at the vaporization rates described above, all the back reaction heat thus produced can be used. The furnace is therefore thermally stable and both heat and material values in the vaporization products are recovered. The concentrated CO remaining after pre-reduction reactions is stripped of minor percentages by weight of sub-micron particles and used to generate art of the electricity needed to operate Zone B.

The reduction product aluminum containing about 10% $Al_4C_3$ is periodically transferred molten to a decarbonizing furnace, shown as 110 in FIG. 4, and further processed to produce commercially pure aluminum as described in Examples 8 and 9.

EXAMPLE 11

Figure 5:
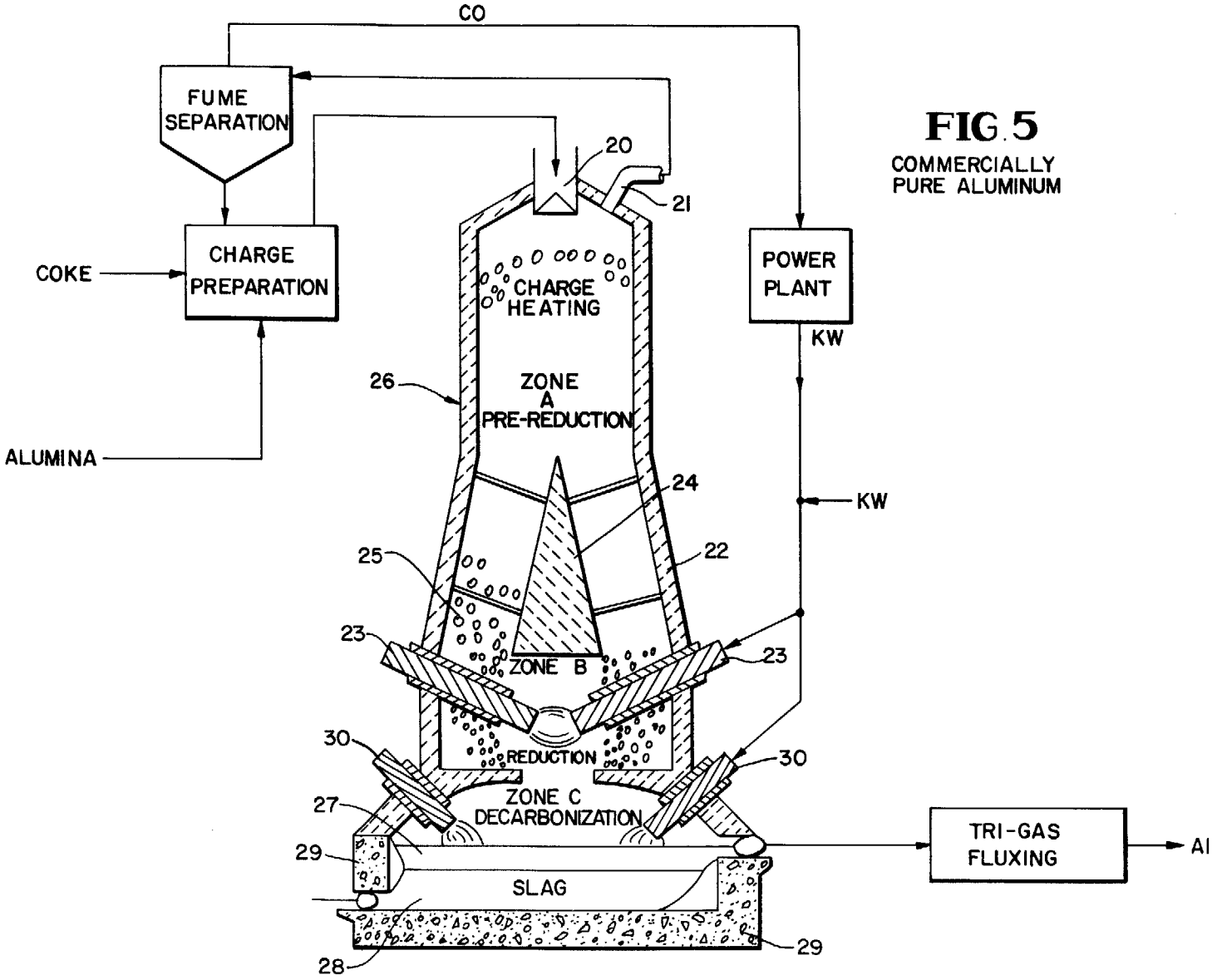
FIG. 5 represents still another furnace which can be used. In this figure, the lining materials 29 of the decarbonizating section are high alumina-containing refractories which are substantially free from carbon. In this furnace, the furnace product falls to mix with the layer 27 of aluminum containing less than 2% aluminum carbide resting upon the liquid slag layer 28 containing sufficient calcium oxide to be fluid at 1500° C. Heat is supplied by electrodes 30 to cause the carbide in the reduction product to react with the alumina in the slag to produce liquid aluminum.

FIG. 5 illustrates a combination of preferred embodiments into one furnace for the production of aluminum containing less than 2% $Al_4C_3$. The lining materials 29 of the decarbonizing section are high alumina or other suitably stable refractories which do not contain carbon.

The charge formulation, pre-reduction, and reduction reactions and apparatus therefore are as described in Example 10. In this example, the reduction product containing about 10% $Al_4C_3$ falls to mix with a layer 27 of the aluminum containing less than 2% $Al_4C_3$ resting upon a liquid slag layer 28 containing sufficient calcium oxide to be fluid at 1500° C. The volume of layer 27 is large in relation to the rate at which reduction product is added to layer 27. Heat is supplied by electrodes 30 to cause the carbide in the reduction product to react with alumina in the slag to produce liquid aluminum and CO. Alumina may be periodically added to the lower chamber, Zone C, to maintain the $Al_2O_3/Al_4C_3$ ratio in preferred range described in Example 6. Alternatively the ratio of charge compositions A to B can be adjusted to maintain the desired $Al_2O_3/Al_4C_3$ ratio is described in Example 6. Vaporization products from Zone C proceed up to Zone A where they back react to release heat required by Zone A and form pre-reduction products which return to reduction Zone B.

EXAMPLE 12

This example illustrates the extraction mode of operation. A slag of nominal composition 15% CaO, 85% $Al_2O_3$ was prepared by mixing $Al_2O_3$ with a slag containing 50% CaO and 50% $Al_2O_3$ which had been prepared in a carbon lined resistance furnace. The slag which initially contained about 0.12% C. was melted at about 1830° C. in a sealed refractory walled furnace which was heated by passing a current through two horizontal graphite electrodes submerged in the slag. The average power was 10.8 KW. A tap hole was placed in the upper sidewall of the furnace.

Argon was introduced into the sealed furnace at 30 SCFH and CO and $O_2$ in the exit stream were continuously monitored.

Carbothermic furnace product of composition shown in Table 1 was charged onto the surface of the molten slag at a rate of 4.6 lb/hr for 214 minutes. Heat loss from the upper surface was reduced by charging 3.2 lb/hr, a slag-bubble $Al_2O_3$ mixture of the proper proportion (85% $Al_2O_3$, 15% CaO). The rate of CO evolution did not change upon charging the Al–$Al_4C_3$.

Two taps which were made when the liquid level had built up above the level of the tap hole yielded a total of 9.3 lb of metal. The metal flowed freely through a 14 in. graphite trough out of the furnace. An additional 2.6 lb of metal was recovered from the frozen surface of the slag pool at the end of the run. The composition of the decarbonized metal and the slag is given in the table below.

The total weight of slag melted was 74 lb; 97.1% of the available Al in the carbothermic furnace produce was recovered as decarb furnace product with 78.4% of this being recovered by tapping it outside the furnace.

TABLE I

| | Al | $Al_4C_3$ | Fe | C | Inert* | $Al_2O_3$ | CaO |
|---|---|---|---|---|---|---|---|
| Carbothermic Furnace Product | 74.4 | 6.8 | 1.8 | 4.2 | 16.6 | — | — |
| Decarb Metal | 75.7 | 2.8 | 3.6 | 0.76 | 13.6 | — | — |
| Analysis of Slag | 1.1 | 3.1 | 0.2 | 1.9 | 54.7 | 91.8 | 10.7 |

*Material unreactive to cold concentrated HCL

EXAMPLE 13

This example illustrates the reduction mode of operation. The process of Example 12 was repeated except that additional heat was supplied to the surface of the slag using an arc drawn between two vertical electrodes operated in series with current flowing across the melt surface. The average power of the resistance heat source was 10.4 KW and the average power of the surface arc was 26.0 KW. The slag was first melted with no carbothermic furnace product present using resistance heat as in Example 12. With an argon flow of 20 SCFH the baseline CO and $O_2$ contents of the gas were 1.6% and 0.0% respectively. When the surface arc was added to this system the CO increased to 10–14%. After the surface arc has been on for one hour a small lens of metal was observed floating on the liquid slag. The surface arc was then cut off and carbothermic furnace product added.

The CO and $O_2$ concentrations dropped to their previous levels when the surface arc was off. When the surface arc was started with the carbothermic furnace product in the furnace, the CO level increased to 11% and dense white fumes were emitted which quickly plugged the gas sampling line. Carbothermic furnace product was charged at a rate of 4.2 lb/hr for 100 minutes. The experiment was terminated without a tap due to crucible failure, 78.4% (4 lb) of the free Al in the carbothermic furnace product was recovered as product from the surface of the frozen slag melt. A total of 47.8 lb of slag was melted.

The following table gives the compositions of the charge, product, and slag.

| | Al | $Al_4C_3$ | Fe | C | Inert* | $Al_2O_3$ | CaO |
|---|---|---|---|---|---|---|---|
| Carbothermic Furnace Product | 72.3 | 6.8 | 0.9 | 3.3 | 4.2 | — | — |
| Decarbonized Metal | 77.5 | 1.2 | 1.8 | — | 6.0 | | |
| Slag | 0.5 | 0.8 | 0.1 | — | 87.0 | 89.6 | 8.7 |

*Unreacted in cold concentrated HCL

EXAMPLE 14

This example will illustrate the "extraction mode" of operation using the system of FIG. 4.

Referring to FIG. 4, the furnace 18 is a moving bed shaft furnace which is closed except for tapping port 19, charge admission lock 20 and gas vent 21. The furnace is lined with carbon 22 and provided with adjustable electrode means, not shown, to cause electric arcs to flow between two or more electrodes 23. Means 24 constructed of carbon are provided to shape the charge 25 descending and insulating means 26 is provided so that electrical conduction through the charge is minimized.

In one embodiment, a two part charge A and B is prepared as described in Example 6. As the charge descends through Zone A, heat released by the back-reaction of vapor products from Zone B is absorbed to produce pre-reduction products, principally $Al_4O_4C$. As the charge descends closer to the source of arc heat, reactions occur to produce aluminum carbide.

Finally, the charge, now having a composition substantially of the proportion of one mole of $Al_4O_4C$ to one mole $Al_4C_3$, receives heat by radiation from the arc to produce liquid aluminum containing about 10% $Al_4C_3$, and some slag comprising alumina and $Al_4O_4C$. The reduction reaction is endothermic and adjusts its temperature to that required for reduction. The distance between the arc and the charge receiving heat from the arc is also self adjusting; if the charge is too close to the arc, the heat flux to the charge is too high, excessive vaporization occurs and the charge surface recedes until the heat flux is appropriate for the reaction rates obtainable. When, by this natural process, thermal stability is achieved, liquid aluminum is continuously produced on the surface of the charge pellets and vaporization at Zone B is characteristic of equilibrium for the reactants $Al_4O_4C$ and $Al_4C_3$. Thus, at one atmosphere pressure, the vaporization from Zone B is in the form of aluminum vapor and $Al_2O$ (gas) containing about 18% of the aluminum values in the charge. At two atmospheres pressure, the aluminum content of the vapors is about 15% of the aluminum values in the charge. These vapors back react with CO from the reduction Zone B to produce compounds that can be recycled to Zone B to produce aluminum. The back reaction heat is released at a temperature higher than the reaction temperature to produce $Al_4O_4C$ and at the vaporization rates described above, all the back reaction heat thus produced can be used. The furnace is therefore thermally stable and both heat and material values in the vaporization products are recovered. The concentrated CO remaining after pre-reduction reactions is stripped of minor percentages by weight of sub-micron particles and used to generate part of the electricity needed to operated Zone B.

The reduction product aluminum containing about 10% $Al_4C_3$ is periodically transferred molten to a decarbonizing furnace, shown as 110 in FIG. 4 which contains a molten slag 12 having the composition of Example 1 on the hearth of furnace 110. An arc is struck between electrodes 15 and 16 to maintain slag 12 at a temperature of about 2,000° C. The molten furnace product floats upon slag 12 and the aluminum carbide contained therein reacts with it to form non-metallic slag compounds without evolution of carbon monoxide. The alumina consumed from slag 12 by this reaction is replaced by the addition of more alumina to the slag. A net increase in slag weight and depth occurs as a result of said decarbonizing reaction. The decarbonized aluminum is decanted and then the excess slag is recycled to the hearth of furnace 18 where it further reacts to make aluminum.

What is claimed is:

1. A process for decreasing aluminum carbide contamination of aluminum produced by carbothermic processes, said process comprising:

A. preparing said aluminum contaminated with about 2–20 weight percent aluminum carbide as a melt at an initial temperature sufficiently high to keep said melt in a fluid state;

B. contacting said melt with a high-alumina containing molten slag in the absence of reactive carbon so as to cause the alumina-containing slag to react with the aluminum carbide in said melt; and C. recovering aluminum having a diminished aluminum carbon content.

2. The process of claim 1 wherein the high-alumina containing molten slag comprises 80–97 weight percent alumina, balance aluminum carbide.

3. The process of claim 2 wherein the slag comprises 85–90 weight percent alumina.

4. The process of claim 1 wherein the high-alumina containing molten slag comprises:

| | |
|---|---|
| CaO | 10–55 weight percent |
| MgO | O–5 weight percent |
| $Al_4C_3$ | O–18 weight percent |
| Balance Alumina | |

5. The process of claim 4 wherein the calcium oxide comprises 40–45 weight percent.

6. The process of claim 1 wherein said high-alumina containing molten slag melts at about 1500°–1900° C.

7. The process of claim 4 wherein in step (B) a relatively pure aluminum is separated prior to contact with said slag at reduction temperatures.

8. The process of claim 1 wherein the aluminum in step (A) is contaminated with about 10–20 weight percent of aluminum carbide.

* * * * *